US012358099B2

(12) United States Patent
Suzuki et al.

(10) Patent No.: US 12,358,099 B2
(45) Date of Patent: Jul. 15, 2025

(54) DRESSING RING

(71) Applicant: DISCO CORPORATION, Tokyo (JP)

(72) Inventors: Yoshikazu Suzuki, Tokyo (JP); Tomoharu Kihara, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 313 days.

(21) Appl. No.: 17/816,858

(22) Filed: Aug. 2, 2022

(65) Prior Publication Data

US 2023/0051072 A1 Feb. 16, 2023

(30) Foreign Application Priority Data

Aug. 11, 2021 (JP) ..... 2021-131019

(51) Int. Cl.
*B24B 53/12* (2006.01)

(52) U.S. Cl.
CPC ..... *B24B 53/12* (2013.01)

(58) Field of Classification Search
CPC ..... B24B 53/02; B24B 53/005; B24B 53/12; B24B 53/017
See application file for complete search history.

(56) References Cited

U.S. PATENT DOCUMENTS 4,481,738 A * 11/1984 Tabuchi ..... B24B 27/0023 15/4
5,032,203 A * 7/1991 Doy ..... B24B 37/04 438/692
5,749,771 A * 5/1998 Isobe ..... B24B 53/017 451/287
5,902,173 A * 5/1999 Tanaka ..... B24B 53/017 451/287
5,931,725 A * 8/1999 Inaba ..... H01L 21/30625 451/446

(Continued)

FOREIGN PATENT DOCUMENTS

JP 2004063994 A 2/2004
JP 2009248282 A 10/2009

(Continued)

OTHER PUBLICATIONS

Office Action issued in counterpart Singapore patent application No. 10202250656M, dated Aug. 1, 2024.

(Continued)

*Primary Examiner* — Joel D Crandall
(74) *Attorney, Agent, or Firm* — Greer, Burns & Crain, Ltd

(57) ABSTRACT

A dressing ring includes a ring-shaped dressing member for dressing a processing stone. Preferably, the dressing member has an opening in which a workpiece is arranged when the workpiece is ground. Also preferably, the dressing ring further includes a ring-shaped support plate having an upper surface on which the dressing member is fixed. In addition, a grinding method of the workpiece includes the steps of holding the ring-shaped dressing member on a holding surface of a chuck table, holding the workpiece in the opening of the dressing member such that a back surface of the workpiece is located higher than the upper surface of the dressing member, grinding the workpiece by grinding stones of a grinding wheel, and dressing the grinding stones with the dressing member on the holding surface.

12 Claims, 9 Drawing Sheets

(56) References Cited

U.S. PATENT DOCUMENTS 5,984,764 A * 11/1999 Saito ..... B24D 7/06 451/63
6,077,155 A * 6/2000 Hayakawa ..... B24B 49/18 451/288
6,672,945 B1 * 1/2004 Matsuo ..... B24B 53/001 451/72
6,730,191 B2 * 5/2004 Chang ..... B24B 53/017 216/88
8,025,556 B2 * 9/2011 Kajiyama ..... B24B 27/0076 451/41
9,238,288 B2 * 1/2016 Sugiya ..... B24B 1/00
9,604,340 B2 * 3/2017 Lin ..... B24B 37/32
10,022,838 B2 * 7/2018 Akita ..... B24B 53/053
10,265,829 B2 * 4/2019 Tsai ..... B24B 37/20
10,668,595 B2 * 6/2020 Sekiya ..... B24B 53/12
2009/0163120 A1 * 6/2009 Kanazawa ..... H01L 21/304 451/57
2011/0034112 A1 2/2011 Sugano
2014/0183163 A1 * 7/2014 Sugiya ..... B24B 1/00 216/52
2020/0094375 A1 * 3/2020 Tsai ..... B24B 49/16

FOREIGN PATENT DOCUMENTS

JP 2014124690 A 7/2014
JP 2019141949 A 8/2019
WO WO-2009125835 A1 * 10/2009 ..... B24B 53/02

OTHER PUBLICATIONS

Japanese Patent Application No. 2021-131019 : English translation of Office Action, Feb. 18, 2025 (3 pages).

* cited by examiner

DRESSING RING

BACKGROUND OF THE INVENTION

Field of the Invention

The present invention relates to a dressing ring including a ring-shaped dressing member for dressing a processing stone, and to a grinding method of a workpiece which includes a grinding step of grinding the workpiece by a grinding wheel and a dressing step of dressing a plurality of grinding stones of the grinding wheel by the dressing member.

Description of the Related Art

In a manufacturing process of semiconductor device chips, devices such as integrated circuits (ICs) are first formed in individual regions defined by a plurality of streets, for example, on a wafer that is made of a semiconductor such as silicon and that includes the streets set in a grid pattern on a front surface thereof. Next, after the wafer is ground on a side of a back surface thereof to thin the same, the wafer is divided along the individual streets. As a consequence, the wafer is divided into a plurality of semiconductor device chips. In the grinding of the wafer (workpiece), a grinding machine is used (see, for example, JP 2014-124690A).

The grinding machine includes a disc-shaped chuck table that holds the workpiece under suction. Above the chuck table, a grinding unit including a spindle is disposed. On a lower end portion of the spindle, a disc-shaped wheel mount is fixed, and on a lower surface of the wheel mount, an annular grinding wheel is mounted. The grinding wheel has an annular wheel base, and on a lower surface of the wheel base, grinding stones are arranged at substantially equal intervals along a peripheral direction of the wheel base. Each grinding stone has abrasive grains and a bonding material (binding material) fixing the abrasive grains together.

As the grinding of the workpiece by the grinding wheel proceeds, the grinding ability on a side of lower surfaces of the grinding stones decreases due to loading, glazing, and the like. It is hence needed to periodically dress the grinding stones to restore their grinding ability. To perform the dressing, however, first substitution work is needed to move a workpiece which has been held under suction on the chuck table, from the chuck table to another plate, and then hold a disc-shaped dressing board under suction on the chuck table.

Further, after the dressing is finished, second substitution work is also needed to move the dressing board which has been held under suction on the chuck table, from the chuck table to a further place, and then hold a workpiece under suction on the chuck table. The first and second substitution works need to be performed every time dressing is performed, so that the efficiency of the grinding work decreases by the time needed for the first and second substitution works.

SUMMARY OF THE INVENTION

With such a problem in view, the present invention has as an object thereof to shorten the time needed for substitution work between a workpiece and a dressing board when grinding stones are dressed.

In accordance with an aspect of the present invention, there is provided a dressing ring including a ring-shaped dressing member for dressing a processing stone.

Preferably, the dressing member may have an opening in which a workpiece is arranged when the workpiece is ground.

Also preferably, the dressing ring may further include a ring-shaped support plate having an upper surface on which the dressing member is fixed.

In accordance with another aspect of the present invention, there is provided a grinding method of a workpiece having a front surface and a back surface. The grinding method includes a dressing member holding step of holding a ring-shaped dressing member that has an upper surface and an opening and is for dressing a plurality of grinding stones of a grinding wheel, on a holding surface of a chuck table, the holding surface being capable of holding the workpiece thereon, a workpiece holding step of holding the workpiece, with the front surface thereof directed downward, in the opening of the dressing member held on the holding surface such that the back surface of the workpiece is located higher than the upper surface of the dressing member, a grinding step of grinding the workpiece by the grinding wheel that is rotating about an axis of rotation of a spindle, and a dressing step of dressing the grinding stones with the dressing member by relatively moving the grinding wheel toward the holding surface while rotating the chuck table about a predetermined axis of rotation with the grinding wheel positioned above the dressing member and further outside of the workpiece in a radial direction of the holding surface.

Preferably, the grinding step may include creep feed grinding that grinds the workpiece while relatively moving the grinding wheel, which is rotating about the axis of rotation of the spindle with lower surfaces of the grinding stones arranged at a predetermined height position lower than the back surface of the workpiece held on the holding surface but higher than the upper surface of the dressing member, and the chuck table, which holds the workpiece thereon and is not rotating about the predetermined axis of rotation, in a predetermined direction orthogonal to a longitudinal direction of the spindle.

Also preferably, the grinding step may include infeed grinding that grinds the workpiece while relatively moving the grinding wheel, which is rotating about the axis of rotation of the spindle, and the chuck table, which holds the workpiece thereon and is rotating about the predetermined axis of rotation, along a longitudinal direction of the spindle.

The dressing ring according to the aspect of the present invention includes the ring-shaped dressing member for dressing the processing stone. By arranging the workpiece in the opening of the dressing ring, for example, the dressing ring and the workpiece can concurrently be held under suction on the chuck table. It is therefore possible to eliminate the time that would otherwise be needed for the substitution work between the workpiece and a dressing board on the chuck table.

The grinding method of the workpiece according to the other aspect of the present invention includes the dressing member holding step of holding the ring-shaped dressing member on the holding surface of the chuck table, the workpiece holding step of holding the workpiece in the opening of the dressing member such that the back surface of the workpiece is located higher than the upper surface of the dressing member, the grinding step, and the dressing step. In the grinding step, the workpiece can be ground by the grinding wheel that is rotating about the axis of rotation of the spindle.

Further, in the dressing step, the grinding wheel is positioned above the dressing member and further outside of the workpiece in the radial direction of the holding surface. By relatively moving the grinding wheel toward the holding surface in the above-mentioned state while rotating the chuck table about the predetermined axis of rotation, the grinding stones can be dressed with the dressing member. Since the dressing ring and the workpiece can concurrently be held under suction on the chuck table as described above, it is possible to eliminate the time that would otherwise be needed for the substitution work between the workpiece and the dressing board on the chuck table.

The above and other objects, features and advantages of the present invention and the manner of realizing them will become more apparent, and the invention itself will best be understood from a study of the following description and appended claims with reference to the attached drawings showing some preferred embodiments of the invention.

DETAILED DESCRIPTION OF THE PREFERRED EMBODIMENTS

Figure 1A:
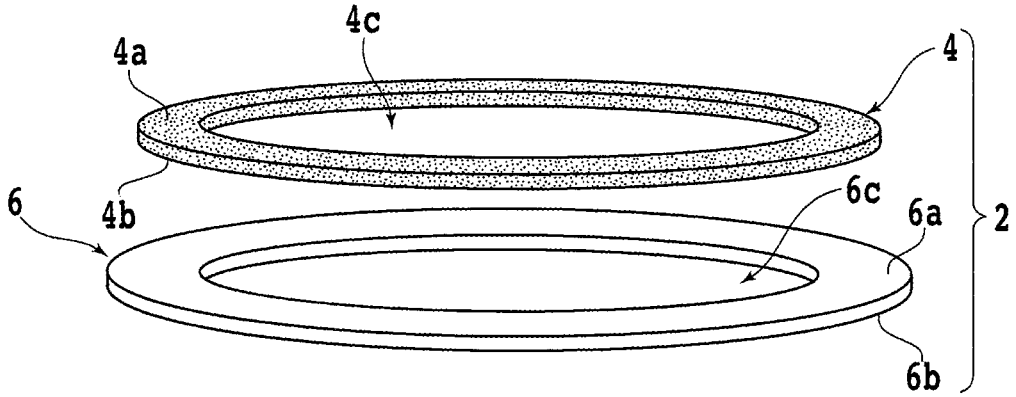
FIG. 1A is a perspective view of a dressing member and a support plate in a dressing ring according to an embodiment of a first aspect of the present invention.
Figure 1B:
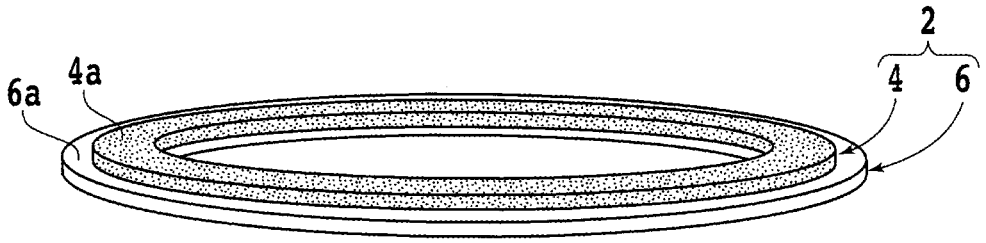
FIG. 1B is a perspective view of the dressing ring of FIG. TA.

With reference to FIGS. 1A and 1B of the attached drawings, a description will be made regarding a dressing ring 2 according to an embodiment of a first aspect of the present invention. The construction, shape, and the like of the dressing ring 2 for use in dressing will be described first. FIG. 1A is a perspective view of a dressing member 4 and a support plate 6 that are included in the dressing ring 2, and FIG. 1B is a perspective view of the dressing ring 2. The dressing member 4 is used to dress a processing stone(s) such as grinding stones 26*b* to be described below or a cutting stone of a cutting blade (not illustrated). The dressing member 4 contains abrasive grains of white alundum (WA), green carbon (GC), or the like and a bonding material (binding material) such as a vitrified bond or a resin bond with which the abrasive grains are fixed together.

The dressing member 4 in this embodiment is in the shape of a planar ring having an upper surface 4*a* and a lower surface 4*b* and has, at a central part thereof, an opening 4*c* that is arranged substantially concentrically with its outer periphery and that has a predetermined diameter. The dressing member 4 has a thickness of, for example, approximately several hundred micrometers to 1 mm. It is to be noted that the thickness of the dressing member 4 may be set appropriately according to the thickness of a workpiece 11 (see FIG. 4A, etc.). The support plate 6 is in the shape of a planar ring and has an upper surface 6*a* and a lower surface 6*b*. The dressing member 4 is fixed at the lower surface 4*b* thereof on the upper surface 6*a* of the support plate 6 with an adhesive (not illustrated). The support plate 6 is made of, for example, such a resin as an acrylic resin or a vinyl chloride resin or a composite material such as glass fiber-reinforced polyethylene terephthalate.

The thickness of the support plate 6 is, for example, approximately several hundred micrometers to 1 mm. However, the support plate 6 may have a thickness set appropriately according to the thickness of the workpiece 11. The support plate 6 in this embodiment has an outer diameter greater than that of the dressing member 4. The support plate 6 has an opening 6*c* arranged substantially concentrically with its outer periphery. The opening 6*c* has substantially the same diameter as the opening 4*c* of the dressing member 4. The support plate 6 is arranged relative to the dressing member 4 such that the opening 6*c* coincides in center with the opening 4*c* as seen in top plan view.

Figure 2:
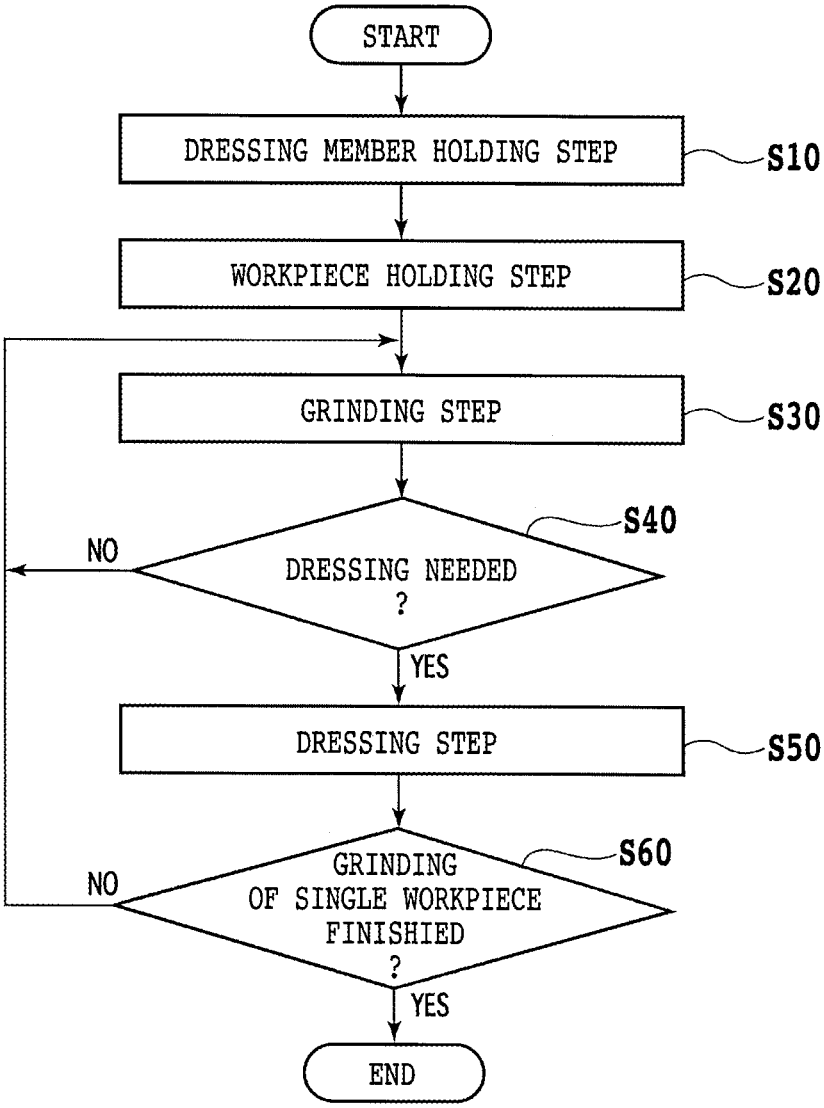
FIG. 2 is a flow diagram illustrating a grinding method according to a first embodiment of a second aspect of the present invention for a single workpiece.

Referring to FIGS. 2 through 6B, a description will next be made regarding a grinding method according to a first embodiment of a second aspect of the present invention for the single workpiece 11. FIG. 2 is a flow diagram illustrating the grinding method according to the first embodiment when creep feed grinding is applied to the single workpiece 11. For the grinding of the workpiece 11, a grinding machine 8 (see FIG. 5A) is used. Here, the construction of the grinding machine 8 is described with reference to FIGS. 5A and 5B. It is to be noted that an X-axis direction (front and rear direction), a Y-axis direction (left and right direction), and a Z-axis direction (up and down direction), all of which are indicated in FIGS. 5A and 5B, are orthogonal to one another.

The grinding machine 8 has a disc-shaped chuck table 10. The chuck table 10 has a frame 12 made of nonporous ceramics or the like. The frame 12 has a bottomed cylindrical shape of a diameter sufficiently greater than its height. In a bottom surface of a cylindrical recessed portion of the frame 12, a plurality of flow paths is formed radially. In the frame 12, a central flow path is also formed such that it extends through the center of the bottom surface of the recessed portion. The central flow path is connected at one end thereof to the radially formed flow paths, and at the other end thereof to a suction source (not illustrated) such as a vacuum pump or ejector.

A disc-shaped porous plate 14 made of porous ceramics is fixed in the recessed portion of the frame 12. On an outer peripheral portion of the porous plate 14, a nonporous ring 16 made of similar ceramics to the frame 12 is disposed. Further, on an outer peripheral portion of the nonporous ring 16, a porous ring 18 made of porous ceramics like the porous plate 14 is disposed. The porous ring 18, at an outer peripheral side surface thereof, is in contact with an inner peripheral side surface of the frame 12. The frame 12, the porous plate 14, the nonporous ring 16, and the porous ring 18 are flush with one another at their upper surfaces, thereby constituting a substantially planar holding surface 10*a*. A negative pressure is transmitted from the suction source to each of the upper surfaces of the porous plate 14 and the porous ring 18. It is to be noted that, in this embodiment, the porous plate 14 is substantially the same in diameter as the workpiece 11 and the outer diameter of the nonporous ring 16 (in other words, the inner diameter of the porous ring 18) is substantially the same as the inner diameters of the openings 4*c* and 6*c*.

Below the chuck table 10, a rotary drive source such as a motor is disposed. The chuck table 10 is rotatable by the rotary drive source about a predetermined axis of rotation (for example, an axis 10*b* of rotation (see FIG. 6A) set substantially in parallel with the Z-axis direction). The rotary drive source is supported on an X-axis direction moving plate (not illustrated) that constitutes an X-axis direction moving mechanism (not illustrated). The X-axis direction moving plate is slidably mounted on a pair of guide rails (not illustrated) arranged substantially in parallel with the X-axis direction.

On a side of a lower surface of the X-axis direction moving plate, a nut portion (not illustrated) is disposed. To this nut portion, a ball screw (not illustrated) is rotatably connected. The ball screw is arranged substantially in parallel with the X-axis direction between the paired guide rails. To one end portion of the ball screw, a drive source (not illustrated) such as a stepping motor is connected. When the drive source is operated, the X-axis direction moving plate moves along the X-axis direction. Above the chuck table 10, a grinding unit 20 is arranged.

To the grinding unit 20, a Z-axis direction moving mechanism (not illustrated) is connected. The Z-axis direction moving mechanism has a pair of guide rails (not illustrated) arranged along the Z-axis direction. On the pair of guide rails, a Z-axis direction moving plate (not illustrated) is slidably mounted. On a rear side of the Z-axis direction moving plate, a nut portion (not illustrated) is disposed. To the nut portion, a ball screw (not illustrated) that is disposed along the Z-axis direction between the paired guide rails is rotatably connected via a plurality of balls (not illustrated).

A drive source (not illustrated) such as a stepping motor is connected to an upper end portion of the ball screw. When the ball screw is rotated by the drive source, the Z-axis direction moving plate is moved in the Z-axis direction along the guide rails. The above-mentioned grinding unit 20 is fixed on the Z-axis direction moving plate. The grinding unit 20 has a cylindrical spindle housing (not illustrated). A cylindrical spindle 22 is rotatably accommodated at a portion thereof in the spindle housing. The spindle 22 in this embodiment is arranged with a longitudinal direction thereof, that is, an axis 22*a* of rotation thereof, arranged along the Z-axis direction.

On an upper end portion of the spindle 22, a rotary drive source (not illustrated) such as a motor is disposed. On a lower end portion of the spindle 22, an annular grinding wheel 26 is mounted via a disc-shaped wheel mount 24. The grinding wheel 26 has an annular wheel base 26*a* made of a metal material such as an aluminum alloy. On a lower surface of the wheel base 26*a*, the grinding stones 26*b* are arranged at substantially equal intervals along a peripheral direction of the lower surface of the wheel base 26*a*. The grinding stones 26*b* contain, for example, a binding material formed of metal, ceramics, resin, or the like and abrasive grains formed of diamond, cubic boron nitride (cBN), or the like. When the spindle 22 is rotated, the grinding wheel 26 rotates about the axis 22*a* of rotation of the spindle 22. When the workpiece 11 is ground, grinding water such as pure water is supplied from a grinding water supply nozzle (not illustrated) to a region of contact between the workpiece 11 and the grinding stones 26*b*.

Figure 3A:
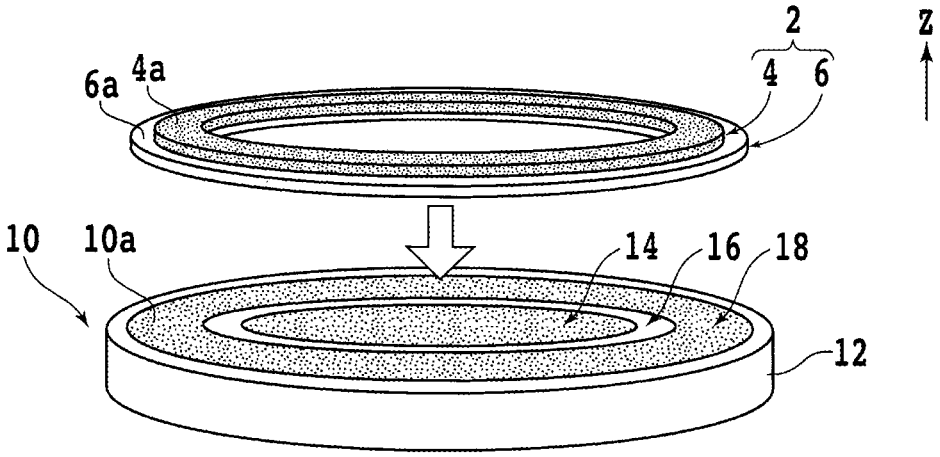
FIG. 3A is a view illustrating a dressing member holding step in the grinding method of FIG. 2.
Figure 3B:
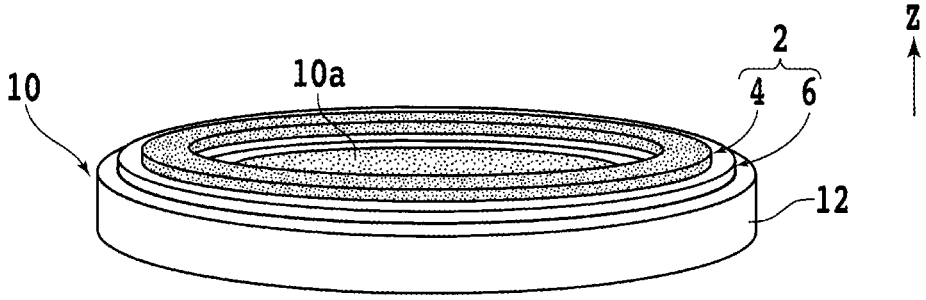
FIG. 3B is a perspective view of the dressing ring of FIG. 1B held on a holding surface of a chuck table in the dressing member holding step of FIG. 3A.

When the workpiece 11 is ground with the grinding machine 8, the dressing ring 2 is first arranged on the holding surface 10*a* such that the dressing ring 2 overlaps with the porous ring 18 and the upper surface 4*a* is directed upward (see FIG. 3A). The suction source is next operated to hold the dressing ring 2 under suction on the porous ring 18 (in other words, a part of the holding surface 10*a*) (dressing member holding step S10). FIG. 3A is a view illustrating the dressing member holding step S10, and FIG. 3B is a perspective view of the dressing ring 2 held on the holding surface 10*a*.

Figure 4A:
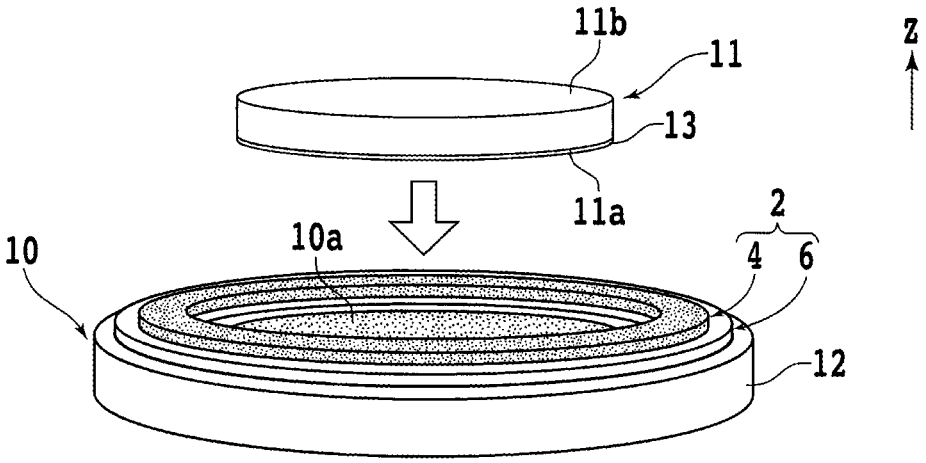
FIG. 4A is a view illustrating a workpiece holding step in the grinding method of FIG. 2.

After the dressing member holding step S10, the workpiece 11 of substantially the same diameter as an outer periphery of the porous plate 14 is arranged in the openings (specifically, the openings 4*c* and 6*c*) of the dressing ring 2 (see FIG. 4A). The workpiece 11 is, for example, a disc-shaped wafer made of silicon and having a plurality of devices (not illustrated) formed on a front surface 11*a* thereof. No particular limitation is however imposed on the material of the workpiece 11. The workpiece 11 may be made of a compound semiconductor such as silicon carbide (SiC) or gallium nitride (GaN) or may be made of another material.

Figure 4B:
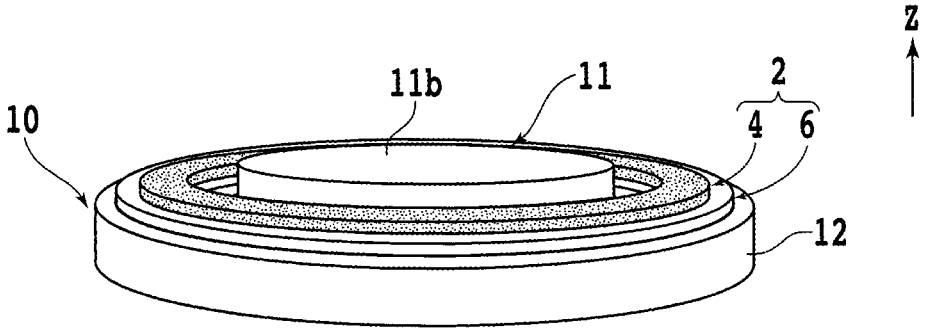
FIG. 4B is a perspective view of the workpiece held on the holding surface of the chuck table in the workpiece holding step of FIG. 4A.

On the side of the front surface 11*a* of the workpiece 11, a protective tape 13 made of resin is bonded. The side of the front surface 11*a* of the workpiece 11 is held under suction on the porous plate 14 (in other words, another part of the holding surface 10*a*) via the protective tape 13 such that a back surface 11*b* of the workpiece 11 is exposed upward (workpiece holding step S20). FIG. 4A is a view illustrating the workpiece holding step S20, and FIG. 4B is a perspective view of the workpiece 11 held on the holding surface 10*a*. The total thickness of the protective tape 13 and the workpiece 11 that is yet to be ground is greater than the thickness of the dressing ring 2 (in other words, the distance from the upper surface 4*a* to the lower surface 6*b*). When the side of the front surface 11*a* is held under suction on the holding surface 10*a*, the back surface (upper surface) 11*b* of the workpiece 11 is therefore located higher than the upper surface 4*a* of the dressing member 4.

The thickness of the dressing ring 2 is adjusted such that the upper surface 4*a* of the dressing member 4 is located lower than a height corresponding to the thickness of the workpiece 11 that has been ground by the grinding machine 8. It is to be noted that the height position of the upper surface 4*a* may be adjusted by disposing annular stepped portions (not illustrated) on the porous ring 18 and an outer peripheral portion of the frame 12. With the annular stepped portions disposed, the upper surface 4*a* of the dressing member 4 can be arranged lower than the height corresponding to the thickness of the workpiece 11 that has been ground. Further, when the thickness of the dressing ring 2 is set at a predetermined value or greater, the mechanical strength of the dressing ring 2 can be ensured.

Figure 5A:
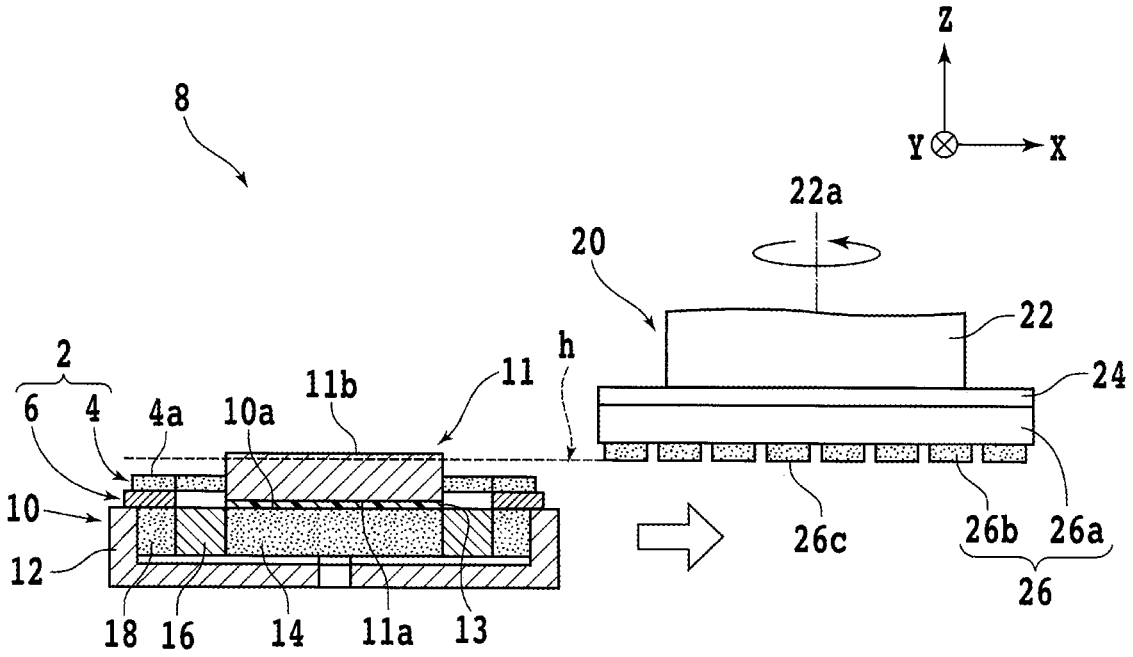
FIG. 5A is a partly cross-sectional side view illustrating creep feed grinding as a first example of a grinding step in the grinding method of FIG. 2.
Figure 5B:
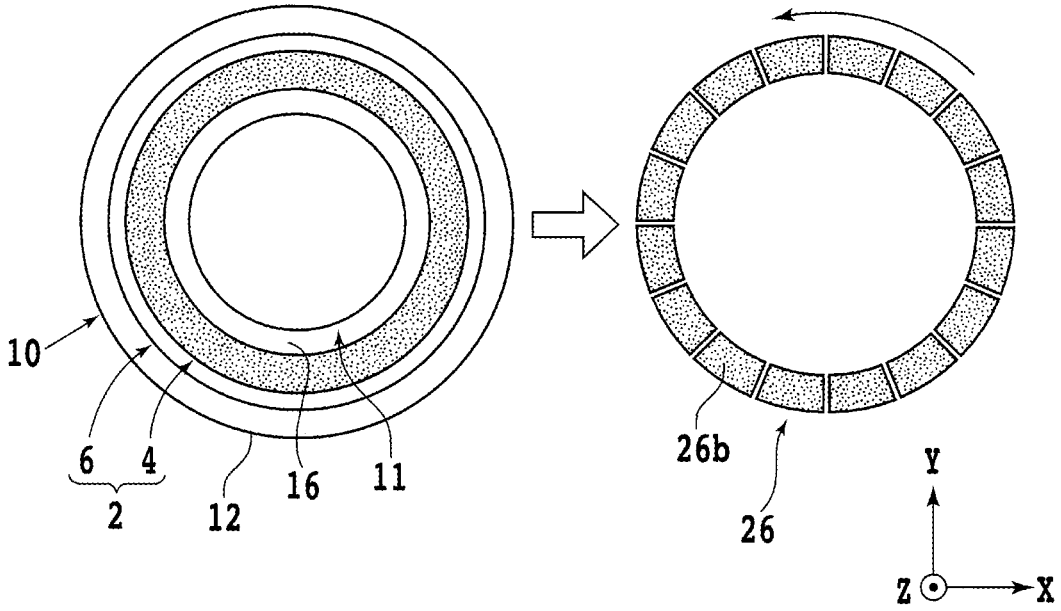
FIG. 5B is a top view illustrating the creep feed grinding of FIG. 5A.

After the workpiece holding step S20, the workpiece 11 is ground (grinding step S30). In the grinding step S30 in this embodiment, creep feed grinding is applied as a first example to the workpiece 11. FIG. 5A is a partly cross-sectional side view illustrating the creep feed grinding as the first example of the grinding step S30, and FIG. 5B is a top view illustrating the creep feed grinding. In the creep feed grinding, lower surfaces 26*c* of the grinding stones 26*b* of the grinding wheel 26, which is rotating about the axis 22*a* of rotation of the spindle 22, are arranged at a height position h lower than the back surface 11*b* of the workpiece 11 held under suction on the holding surface 10*a* but higher than the upper surface 4*a* of the dressing member 4. Further, the chuck table 10 with the workpiece 11 held thereon is moved from a predetermined moving start position along the X-axis direction (predetermined direction) as indicated by an arrow in FIGS. 5A and 5B without rotation of the chuck table 10 about the axis 10*b* of rotation.

When the workpiece 11 moves right below the grinding stones 26*b*, the back surface 11*b* of the workpiece 11 comes into contact with the lower surfaces 26*c* of the grinding stones 26*b*, and the workpiece 11 is ground on the side of the back surface 11*b* thereof. In this manner, the workpiece 11 is ground on the side of the back surface 11*b* thereof while the chuck table 10 and the grinding wheel 26 are relatively moved in the X-axis direction. After the workpiece 11 has been moved to inside the grinding stones 26*b* arranged in the annular pattern by processing feed of the chuck table 10 in the X-axis direction, the grinding unit 20 is once raised such that the lower surfaces 26*c* of the grinding stones 26*b* are located higher than the back surface 11*b*. After that, the chuck table 10 is returned to the predetermined moving start position.

The single pass of grinding (1 pass) by the movement of the chuck table 10 from the predetermined moving start position, the raising of the grinding unit 20, and the returning of the chuck table 10 to the predetermined moving start position are a series of operations to be performed when a single pass of creep feed grinding is to be applied to the single workpiece 11. In order to thin the workpiece 11 to a predetermined thickness, 10 passes (in other words, 10 sets of the series of operations) are needed, for example. In general, however, the grinding ability of the grinding stones 26*b* decreases before 10 passes are finished, and therefore, a need arises to apply dressing to the grinding stones 26*b*. At the time of the finish of the fifth pass, for example, dressing needs to be performed ("YES" in S40) (see FIG. 2). In this case, dressing is performed on the grinding stones 26*b* by the dressing ring 2 (dressing step S50).

Figure 6A:
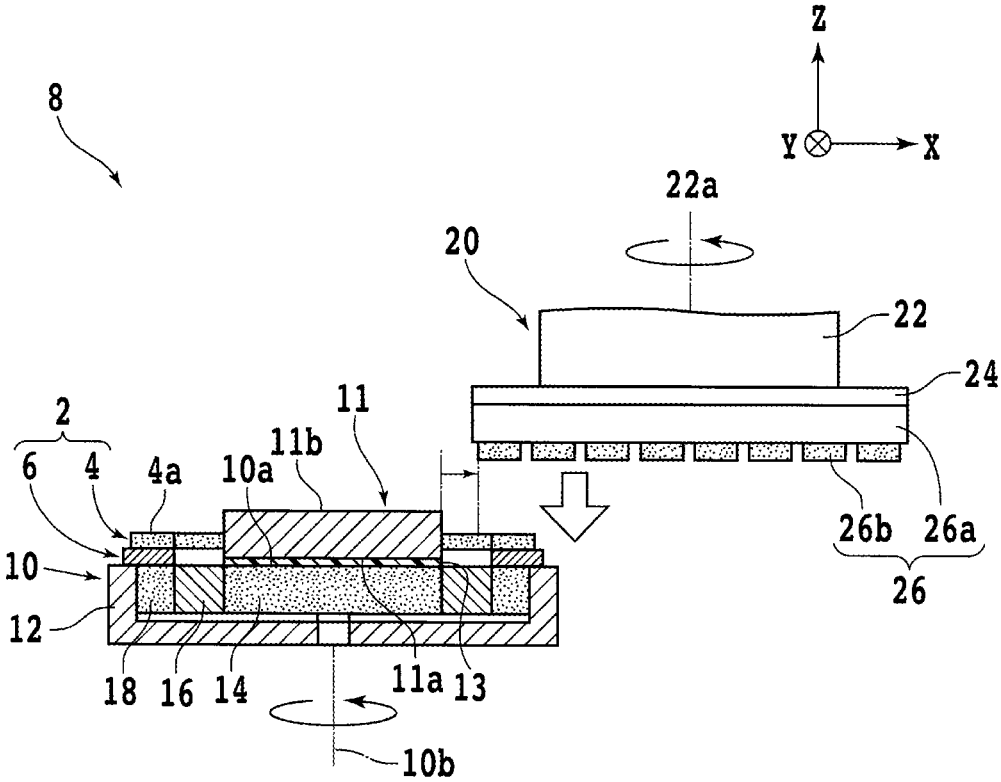
FIG. 6A is a partly cross-sectional side view illustrating a dressing step in the grinding method of FIG. 2.
Figure 6B:
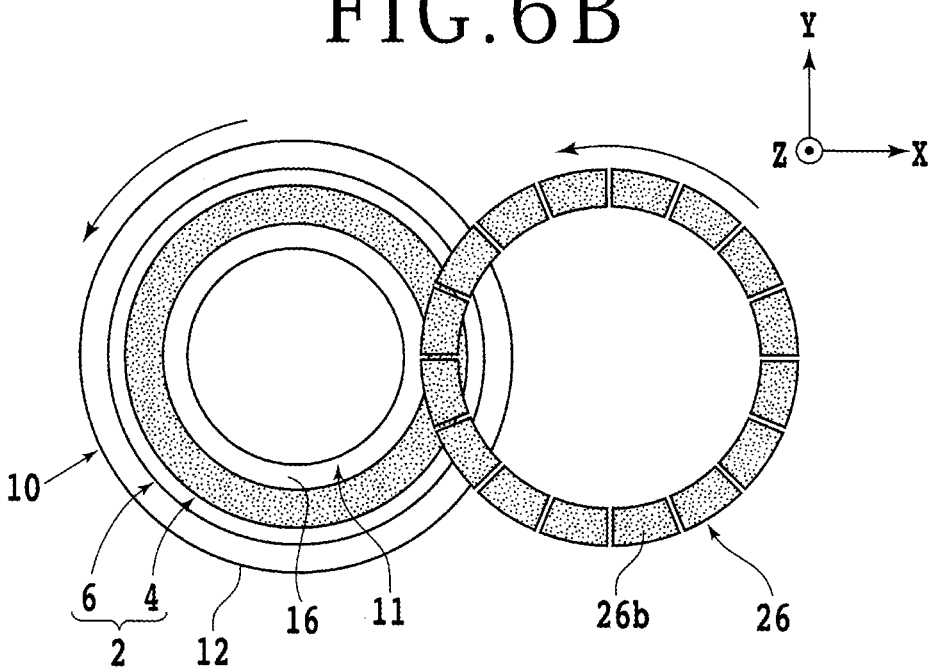
FIG. 6B is a top view illustrating the dressing step of FIG. 6A.

FIG. 6A is a partly cross-sectional side view illustrating the dressing step S50, and FIG. 6B is a top view illustrating the dressing step S50. In the dressing step S50, with the grinding wheel 26 positioned above the dressing member 4 and further outside an outer periphery of the workpiece 11 in a radial direction of the holding surface 10*a*, the grinding wheel 26 is relatively moved toward the holding surface 10*a* as indicated by an arrow in FIG. 6A while the chuck table 10 is rotated about the axis 10*b* of rotation. The rotational speed of the chuck table 10 is set, for example, at a predetermined value of 40 rpm or higher but 300 rpm or lower, whereas the rotational speed of the spindle 22 is set at a predetermined value of 1,000 rpm or higher but 3,000 rpm or lower. Further, the grinding feed rate of, for example, the grinding wheel 26 (in other words, the moving speed at which the grinding wheel 26 is lowered along the Z-axis direction) is set at a predetermined value of 0.5 μm/s or higher but 6.0 μm/s or lower.

If the grinding stones 26*b* are dressed for a predetermined period of time after their lower surfaces 26*c* come into contact with the upper surface 4*a* of the dressing member 4, the grinding ability of the grinding stones 26*b* is substantially restored. When finish-grinding stones 26*b* are to be dressed by a grinding wheel of 200 mm diameter, for example, dressing conditions are set as follows:

Rotational speed of chuck table: 40 rpm
Rotational speed of spindle: 2,000 rpm
Grinding feed rate: 1.0 μm/s
Predetermined period of time: 300 s After the dressing step S50, the grinding of the single workpiece 11 has not been finished yet ("NO" in S60), so that the flow returns to the grinding step S30 to perform creep feed grinding corresponding to the remaining sixth pass to the tenth pass. If the creep feed grinding corresponding to the tenth pass is finished ("YES" in S60), on the other hand, the flow is ended. As the workpiece 11 and the dressing ring 2 can concurrently be held under suction on the holding surface 10*a* in this embodiment as described above, the time that would otherwise be needed for substitution work between the workpiece 11 and the dressing board on the chuck table 10 can be eliminated. In addition, the grinding wheel 26 is subjected to dressing in the manner of infeed grinding (in other words, infeed dressing) in the dressing step S50. It is to be noted that infeed dressing has such a merit that the positions of lower ends of abrasive grains on the lower surfaces 26*c* of the grinding stones 26*b* can be made uniform compared with creep feed dressing in which the grinding wheel 26 is dressed in the manner of creep feed grinding.

Figure 7A:
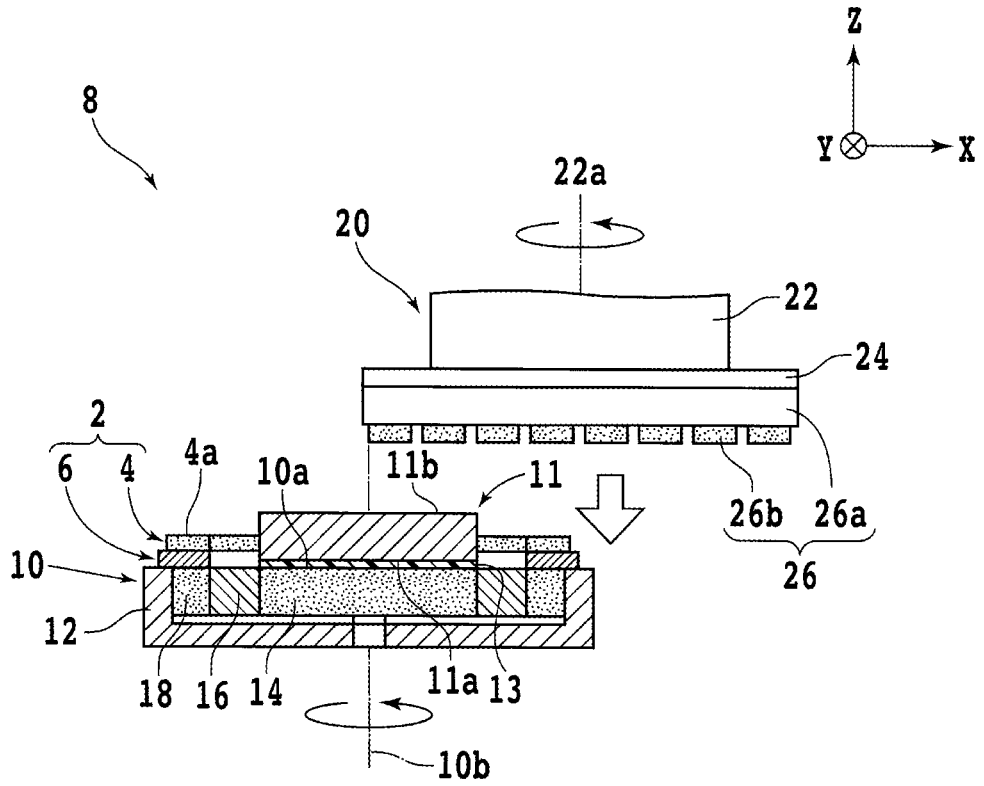
FIG. 7A is a partly cross-sectional side view illustrating infeed grinding as a second example of the grinding step in the grinding method of FIG. 2.
Figure 7B:
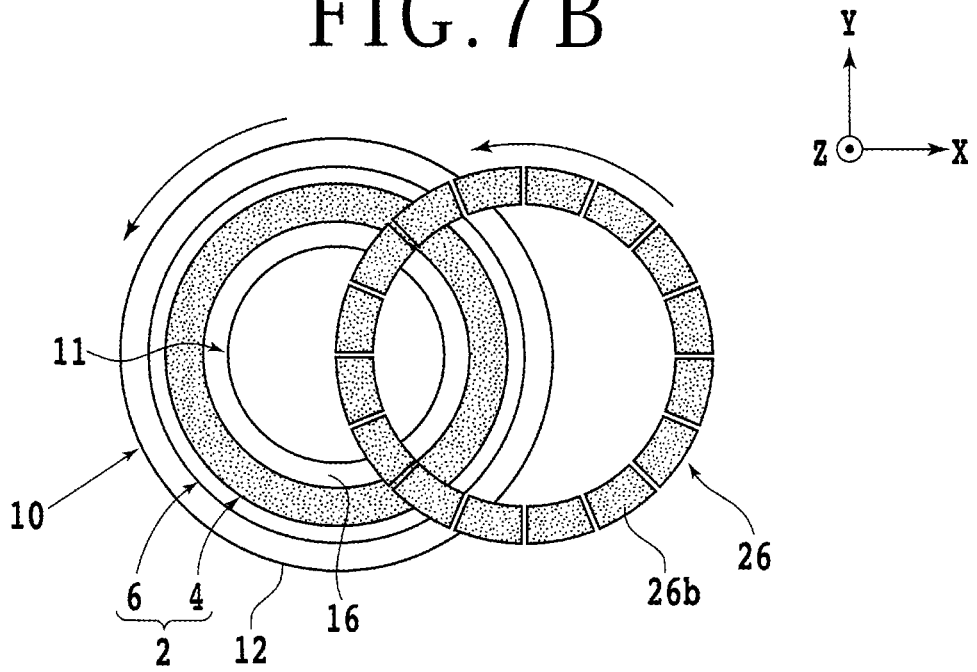
FIG. 7B is a top view illustrating the infeed grinding of FIG. 7A.

With reference to FIGS. 7A and 7B, a description will next be made regarding a second example of the grinding step S30 in the grinding method according to the first embodiment of the second aspect of the present invention for a single workpiece 11. In the grinding step S30 in the grinding method of the second example, infeed grinding is performed instead of creep feed grinding. FIG. 7A is a partly cross-sectional side view illustrating the infeed grinding, and FIG. 7B is a top view illustrating the infeed grinding. The shape of a holding surface 10*a* in the second example of the grinding step S30 is different from that in the first example of the grinding step S30, and has a conical shape slightly protruding at a central portion compared with an outer peripheral portion. In FIG. 7A, however, the holding surface 10*a* is illustrated to be substantially planar for the sake of convenience. In FIG. 7A, the axis 10*b* of rotation is also illustrated to be substantially parallel to the Z-axis direction for the sake of convenience although the axis 10*b* of rotation is tilted with respect to the Z-axis such that a part of the holding surface 10*a* lies substantially parallel to a plane of grinding defined by a trajectory of the lower surfaces 26*c* of the grinding stones 26*b*.

In the infeed grinding, the grinding wheel 26, which is rotating about the axis 22*a* of rotation of the spindle 22, is fed for grinding along the Z-axis direction toward the chuck table 10 that is rotating about the axis 10*b* of rotation with a workpiece 11 held thereon. When the grinding stones 26*b* come into contact with the back surface 11*b* of the workpiece 11, the workpiece 11 is ground on the side of the back surface 11*b*. In this manner, the workpiece 11 is ground while the grinding wheel 26 and the chuck table 10 are relatively moved along the Z-axis direction as indicated by an arrow in FIG. 7A.

Figure 8:
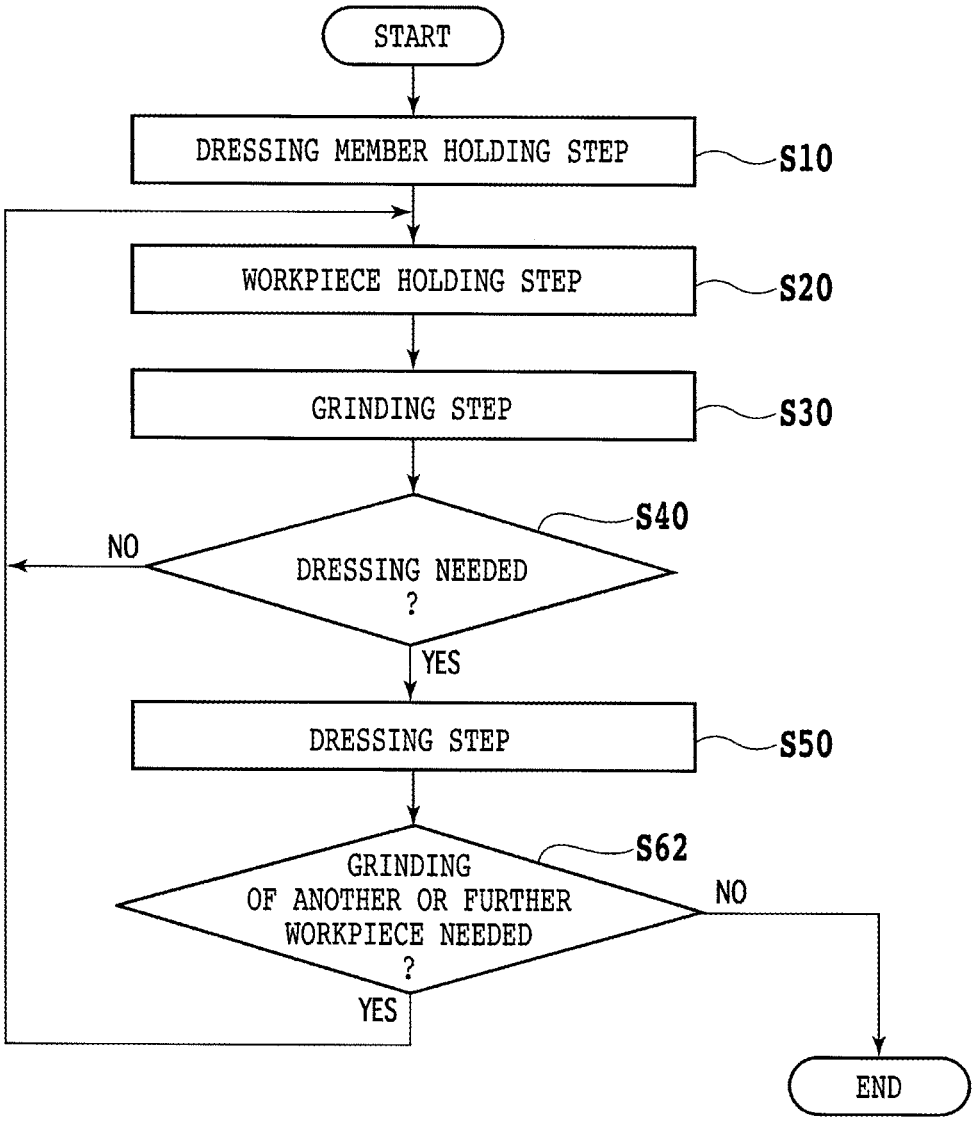
FIG. 8 is a flow diagram illustrating a grinding method according to a second embodiment of the second aspect of the present invention for a plurality of workpieces.

FIG. 8 is a flow diagram illustrating a grinding method according to a second embodiment of the second aspect of the present invention for a plurality of workpieces 11. If dressing is not needed after one of the workpieces 11 has been thinned to a predetermined thickness in the grinding step S30 ("NO" in S40), the workpiece 11 is unloaded from the holding surface 10*a*, another or further one of the workpieces 11 is newly loaded onto the chuck table 10. In this manner, the workpieces 11 are sequentially subjected to infeed grinding. A need, however, arises to perform dressing on the grinding stones 26*b* depending on the extent of a decrease in the grinding ability of the grinding stones 26*b* after one or more of the workpieces 11 have been subjected to the infeed grinding ("YES" in S40). In the second embodiment, infeed dressing is also performed in the dressing step S50, and therefore, the workpiece 11 under processing may be left as held under suction on the holding surface 10*a*. It is to be noted that the workpiece 11 that has been processed may be unloaded from the holding surface 10*a*.

If another or further one of the workpieces 11 is ground after the dressing step S50 ("YES" in S62), the flow returns to the workpiece holding step S20. If another or further workpiece 11 is not ground ("NO" in S62), on the other hand, the flow is ended. As the workpiece 11 and the dressing ring 2 can also be held concurrently under suction on the holding surface 10*a* in this embodiment, the time that would otherwise be needed for substitution work between the workpiece 11 and the dressing board on the chuck table 10 can be eliminated.

Figure 9A:
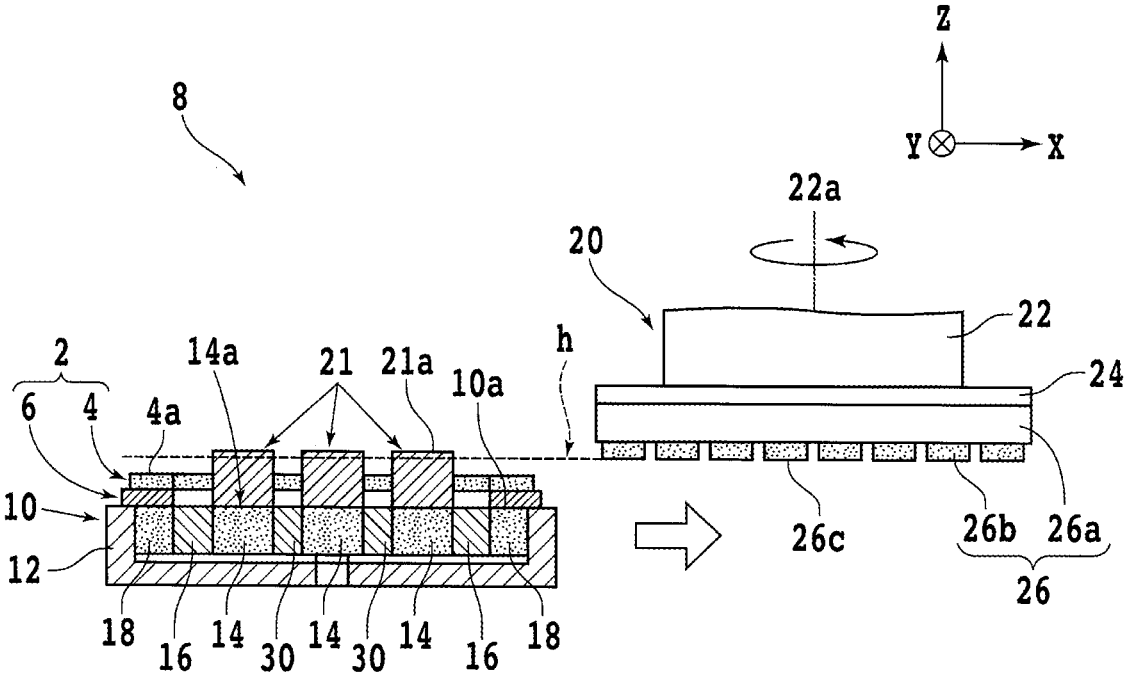
FIG. 9A is a partly cross-sectional side view illustrating creep feed grinding as an example of a grinding step in a grinding method according to a third embodiment of the second aspect of the present invention for a plurality of workpieces.
Figure 9B:
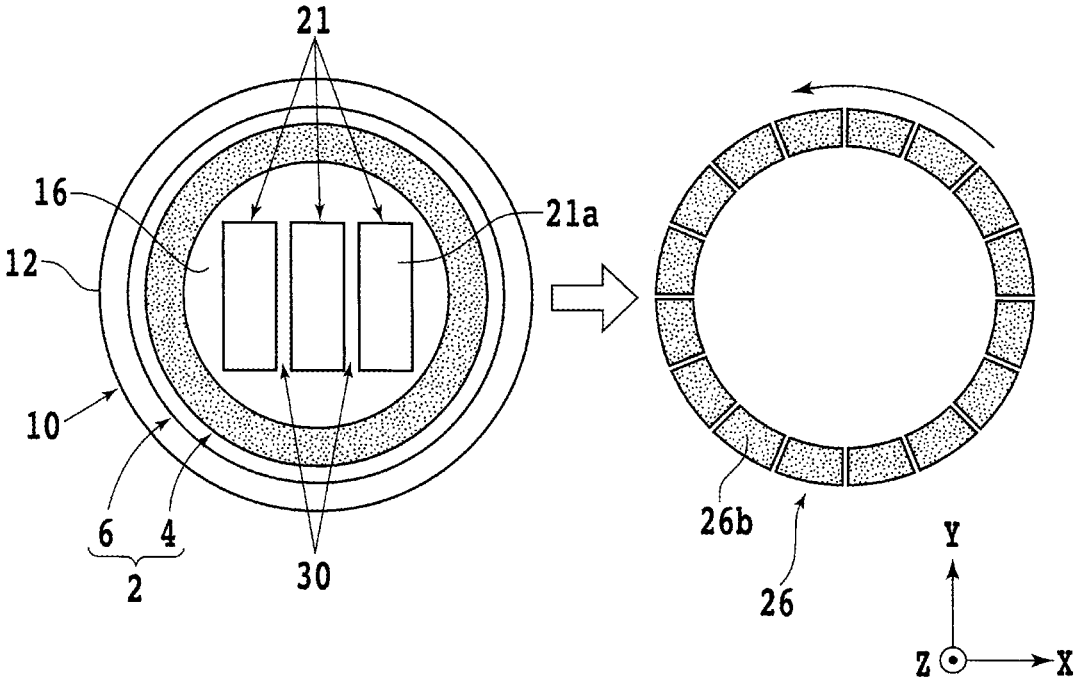
FIG. 9B is a top view illustrating the creep feed grinding of FIG. 9A.

With reference to FIGS. 9A and 9B, a description will next be made regarding a grinding method according to a third embodiment of the second aspect of the present invention. In the third embodiment, creep feed grinding is applied to three strip substrates 21 instead of the single disc-shaped workpiece 11. Each strip substrate 21 has the shape of a rectangular plate, and a plurality of device chips (not illustrated) is disposed inside the strip substrate 21 such that the device chips are covered with a sealing resin, a molding resin, or the like. Each strip substrate 21 is held under suction on a holding surface 10*a*.

A chuck table 10 in the third embodiment is, however, different in construction from those in the first and second embodiments. Described specifically, porous plates 14 are fixed in a recessed portion of a frame 12 and have, on upper surfaces thereof, rectangular suction areas 14*a* corresponding to the respective strip substrates 21. Peripheries of the individual porous plates 14 including the suction areas 14*a* are each surrounded by one or two straight boundary portions 30 made of nonporous ceramics and a nonporous ring 16. It is to be noted that, in the grinding method according to the third embodiment, the holding surface 10*a* is substantially planar as in the first embodiment, and the frame 12, the porous plates 14, the nonporous ring 16, the porous ring 18, and the boundary portions 30 are flush with one another at their upper surfaces.

In the third embodiment, the strip substrates 21 are ground on the side of upper surfaces 21*a* thereof according to the flow illustrated in FIG. 2. In the grinding step S30, the three strip substrates 21 are concurrently held under suction on the chuck table 10, and the chuck table 10 is moved in the X-axis direction as indicated by an arrow in FIGS. 9A and 9B while not being rotated about the axis 10*b* of rotation. Then, the individual strip substrates 21 are subjected to creep feed grinding.

FIG. 9A is a partly cross-sectional side view illustrating the creep feed grinding, and FIG. 9B is a top view illustrating the creep feed grinding. As the strip substrates 21 and the dressing ring 2 can also be held concurrently under suction on the holding surface 10*a* in this embodiment, the time that would otherwise be needed for substitution work between the strip substrates 21 and the dressing board on the chuck table 10 can be eliminated. It is to be noted that the configurations, methods, and the like according to the above-mentioned embodiments can be practiced with changes or modifications made as appropriate to such an extent as not departing from the scope of the object of the present invention.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A grinding method of a workpiece having a front surface and a back surface, comprising:

a dressing member holding step of holding a ring-shaped dressing member that has an upper surface and an opening and is for dressing a plurality of grinding stones of a grinding wheel, on a holding surface of a chuck table, the holding surface being capable of holding the workpiece thereon;

a workpiece holding step of holding the workpiece, with the front surface thereof directed downward, in the opening of the dressing member held on the holding surface such that the back surface of the workpiece is located higher than the upper surface of the dressing member;

a grinding step of grinding the workpiece by the grinding wheel that is rotating about an axis of rotation of a spindle; and a dressing step of dressing the grinding stones with the dressing member by relatively moving the grinding wheel toward the holding surface while rotating the chuck table about a predetermined axis of rotation with the grinding wheel positioned above the dressing member and further outside of the workpiece in a radial direction of the holding surface.

2. The grinding method according to claim 1, wherein the grinding step includes creep feed grinding that grinds the workpiece while relatively moving the grinding wheel and the chuck table in a predetermined direction orthogonal to a longitudinal direction of the spindle, the grinding wheel rotating about the axis of rotation of the spindle with lower surfaces of the grinding stones arranged at a predetermined height position lower than the back surface of the workpiece held on the holding surface but higher than the upper surface of the dressing member, the chuck table holding the workpiece thereon and not rotating about the predetermined axis of rotation.

3. The grinding method according to claim 1, wherein the grinding step includes infeed grinding that grinds the workpiece while relatively moving the grinding wheel and the chuck table along a longitudinal direction of the spindle, the grinding wheel rotating about the axis of rotation of the spindle, the chuck table holding the workpiece thereon and rotating about the predetermined axis of rotation.

4. The grinding method according to claim 1, wherein the dressing member contains abrasive grains of white alundum or green carbon and a bonding material comprising a vitrified bond or a resin bond.

5. The grinding method according to claim 1, wherein the dressing member has a thickness of less than 1 mm.

6. The grinding method according to claim 1, further comprising:

a ring-shaped support plate having an upper surface on which the dressing member is fixed.

7. The grinding method according to claim 6, wherein the support plate is made of a resin or a composite material.

8. The grinding method according to claim 7, wherein the support plate is made of an acrylic resin, a vinyl chloride resin, or glass fiber-reinforced polyethylene terephthalate.

9. The grinding method according to claim 6, wherein the support plate has an outer diameter greater than that of the dressing member, wherein the support plate has an opening, and wherein the opening of the support plate and the opening of the dressing member have the same diameter.

10. The grinding method according to claim 1, wherein the chuck table comprises:

a disc-shaped porous plate fixed in a recessed portion of a frame;

on an outer peripheral portion of the porous plate, a nonporous ring is disposed; and on an outer peripheral portion of the nonporous ring, a porous ring is disposed, wherein the porous ring at an outer peripheral side surface thereof, is in contact with an inner peripheral side surface of the frame;

wherein the frame, the porous plate, the nonporous ring, and the porous ring are flush with one another at their upper surfaces, thereby constituting the holding surface of the chuck table.

11. The grinding method according to claim 10, wherein the porous plate has the same in diameter as the workpiece;

wherein the outer diameter of the nonporous ring is the same as the inner diameter of the opening of the dressing member.

12. The grinding method according to claim 1, wherein in the dressing step:

the rotational speed of the chuck table 10 is set at a predetermined value of 40 rpm or higher but 300 rpm or lower;

the rotational speed of the spindle is set at a predetermined value of 1,000 rpm or higher but 3,000 rpm or lower; and the grinding feed rate is set at a predetermined value of 0.5 μm/s or higher but 6.0 μm/s or lower.

* * * * *